US009097491B2

(12) United States Patent
Summers et al.

(10) Patent No.: US 9,097,491 B2
(45) Date of Patent: Aug. 4, 2015

(54) ELEVATION ADJUSTMENT MECHANISM FOR SIGHT

(71) Applicants: Gregory E. Summers, Amherst, VA (US); Daniel E. Ellgass, Big Island, VA (US)

(72) Inventors: Gregory E. Summers, Amherst, VA (US); Daniel E. Ellgass, Big Island, VA (US)

(73) Assignee: Gregory E. Summers, Madison Heights, VA (US)

( * ) Notice: Subject to any disclaimer, the term of this patent is extended or adjusted under 35 U.S.C. 154(b) by 130 days.

(21) Appl. No.: 14/034,035

(22) Filed: Sep. 23, 2013

(65) Prior Publication Data

US 2015/0082643 A1 Mar. 26, 2015

(51) Int. Cl.
*F41G 1/467* (2006.01)

(52) U.S. Cl.
CPC ..... *F41G 1/467* (2013.01)

(58) Field of Classification Search
CPC ..... F41G 5/14; F41G 1/467
USPC ..... 33/265; 124/87, 88
See application file for complete search history.

(56) References Cited

U.S. PATENT DOCUMENTS

| | | | | | |
|---|---|---|---|---|---|
| 3,854,217 | A * | 12/1974 | Killian | 33/265 |
| 4,020,560 | A * | 5/1977 | Heck | 33/265 |
| 4,481,717 | A * | 11/1984 | Kowalski | 33/265 |
| 4,543,728 | A * | 10/1985 | Kowalski | 33/265 |
| 5,384,966 | A * | 1/1995 | Gibbs | 33/265 |
| 5,507,272 | A * | 4/1996 | Scantlen | 124/87 |
| 2003/0056379 | A1 * | 3/2003 | Johnson et al. | 33/265 |
| 2005/0235503 | A1 * | 10/2005 | Afshari | 33/265 |
| 2013/0174430 | A1 * | 7/2013 | Pulkrabek et al. | 33/265 |
| 2013/0174431 | A1 * | 7/2013 | Pulkrabek et al. | 33/265 |

* cited by examiner

*Primary Examiner* — G. Bradley Bennett
(74) *Attorney, Agent, or Firm* — Leading-Edge Law Group, PLC

(57) ABSTRACT

An adjustable mechanism for an archery sight is characterized by a unique elevation and tension adjustment assemblies which allow a user to quickly and easily set the sight for optimum performance. The mechanism includes an elevation bar having an elevation carriage connected therewith for sliding movement along the bar in a first direction. A windage carriage is connected with the elevation carriage for movement in a second direction, and a sight is connected with the windage carriage. The elevation bar includes a drive screw and the elevation carriage includes a uniquely configured nut releasably connected with the drive screw so that the elevation carriage can be quickly displaced relative to the elevation bar. Tension adjustment between the elevation carriage and the elevation bar is provided by a unique adjustable cam and gib assembly operable by the user. In addition, tension between the windage carriage and the elevation carriage is afforded by a uniquely configured gib of synthetic plastic material in which the tensile strength of the material provides the necessary tension.

20 Claims, 6 Drawing Sheets

ELEVATION ADJUSTMENT MECHANISM FOR SIGHT

BACKGROUND OF THE INVENTION

Sight devices such as those used in archery must be adjustable to fit the user precisely to provide maximum accuracy, particularly where the sight is used in tournaments or other competition. Sights are normally adjustable in three dimensions, with the most important adjustment being in elevation. The present invention relates to an improved elevation adjustment mechanism which allows quick and efficient adjustment of the sight holder relative to an archery bow.

BRIEF DESCRIPTION OF THE PRIOR ART

Many archers attempt to mount their sight approximately thirty inches from their anchor point. A sight bracket is mounted on the bow and an extension bar is connected with the mounting bracket. The extension bar generally extends horizontally when the bow is in use. An elevation bar is connected with the extension bar and is generally perpendicular relative to the elevation bar so that it extends vertically when the bow is in use. A carriage is arranged on the elevation bar and a sight is connected with the carriage. The carriage is displaced by the user along the elevation bar to precisely position the sight at the optimum position. Displacement of the carriage is usually done incrementally, which can be time consuming where more than fine tuning adjustment is required such as where different target distances are used in a tournament. Moreover, conventional adjustment mechanisms do not provide the user with the ability to adjust and lock the tension of elevation travel between the carriage and the elevation bar.

The present invention was developed in order to overcome these and other drawbacks of the prior adjustment devices by providing an elevation adjustment mechanism capable of quick coarse adjustment of the elevation carriage and sight, tension adjustment between the carriage and the elevation bar, and smooth travel of the carriage relative to the elevation bar. When the drive mechanism is released from the screw, the carriage may be manually displaced along the elevation bar.

The drive mechanism includes a pivot nut connected with the elevation carriage. The pivot nut contains a throughbore extending between the ends of the nut. The inner surface of the throughbore contains first threads on one side at one end of the pivot nut and second threads on the opposite side of the inner surface at the other end of the nut. The first and second threads engage threads on the screw when the drive mechanism is in a drive position and are free of the threads on the screw when the drive mechanism is in a release position. A spring-biased button is connected with the elevation carriage and is operable to pivot the pivot nut via a link between the drive and release positions.

According to a further object of the invention, a tension system is provided to adjust the tension of the elevation carriage relative to the elevation bar so that the user can adjust the freedom of movement of the carriage. The tension system includes a yoke adjustably connected with the carriage. The yoke and carriage are arranged on opposite sides of the elevation bar so that when the yoke is drawn to the carriage, tension between carriage and elevation bar is increased. A cam shaft connected with the elevation carriage is operable to move the yoke toward or away from the carriage to adjust the tension between the carriage and the bar. Tension gibs are provided between the yoke and the elevation bar and elevation gibs are provided between the carriage and the elevation bar to further assist in controlling the tension between the carriage and the bar.

A windage carriage may also be provided to connect the sight with the elevation carriage to provide further adjustment of the sight in another dimension. A tension system is also provided to control the freedom of movement of the windage carriage relative to the elevation carriage. A contoured spring gib is arranged between the two carriages. It is formed of a synthetic plastic material having a tensile strength displacement which provides the necessary tension between the carriages.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
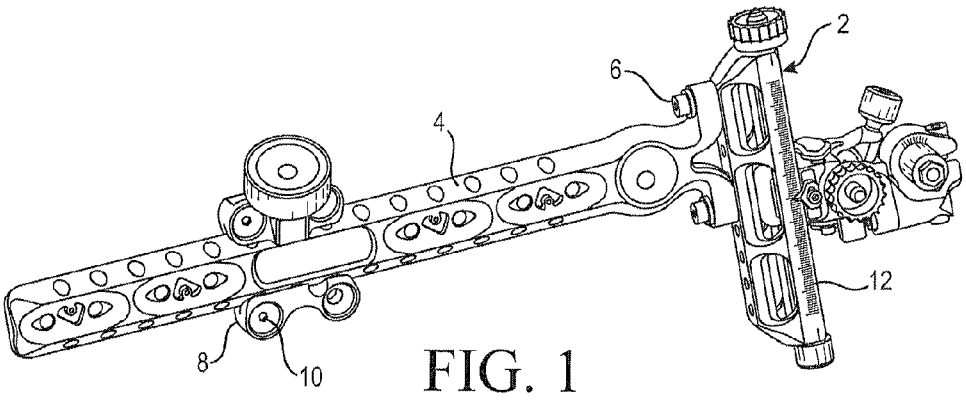
FIG. 1 is a perspective view of an elevation adjustment mechanism for a sight according to the invention connected with an extension bar for mounting on a bow.
Figure 2:
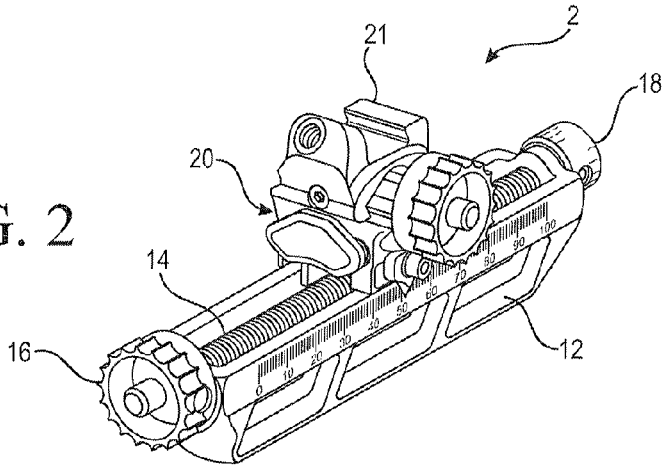
FIG. 2 is a detailed perspective view of the elevation adjustment mechanism shown in FIG. 1.
Figure 3:
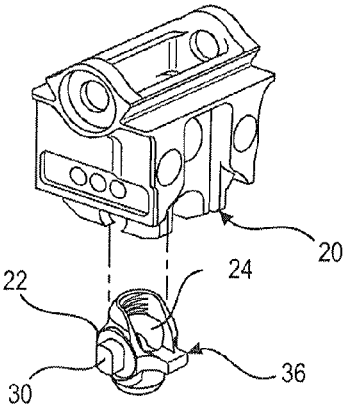
FIG. 3 is an exploded sectional view of the elevation carriage and pivot nut of the adjustment mechanism.
Figure 4:
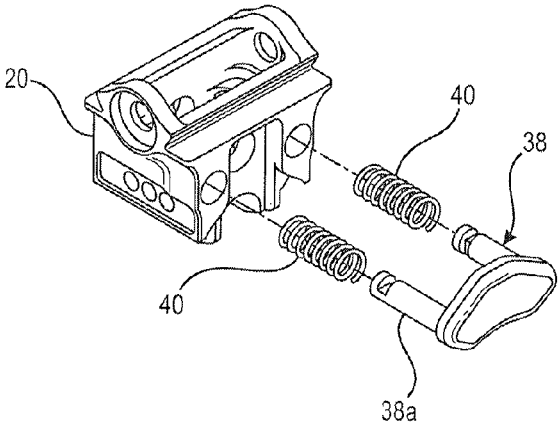
FIG. 4 is an exploded perspective view of the spring-biased button of the elevation carriage.
Figure 5:
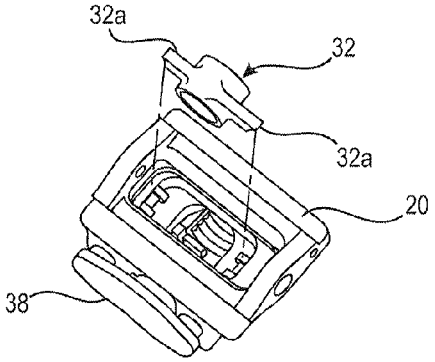
FIG. 5 is a bottom view of the elevation carriage showing the mounting arrangement of a link of the drive mechanism.
Figure 6:
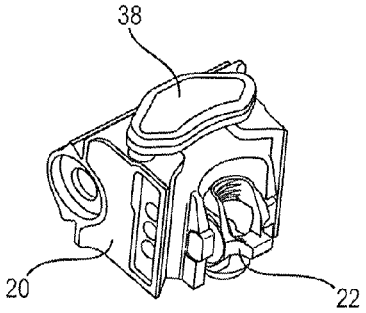
FIG. 6 is a perspective view of the assembled elevation carriage.
Figure 7:
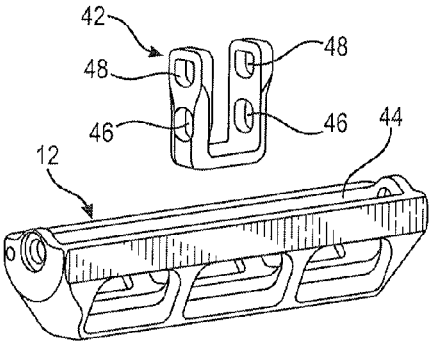
FIGS. 7-9 are exploded views showing how the elevation carriage is connected with the elevation bar according to the invention.

Referring first to FIGS. 1 and 2, the archery sight adjustment mechanism according to the invention is shown. The elevation adjustment mechanism 2 is connected with an extension bar 4 via screws 6 or other suitable fasteners. The extension bar is connected with a mounting plate 8 attached to a bow (not shown) via screws 10 or other suitable fasteners. In use, the extension bar generally extends horizontally and the elevation adjustment mechanism extends vertically, with the sight being adjusted for elevation along an elevation bar 12.

As shown more particularly in FIG. 2, the elevation bar includes an elongated screw 14 rotatably connected therewith. Knobs 16 and 18 are mounted on the ends of the screw 14 to rotate the screw relative to the extension bar. Both the elevation bar and the extension bar contain a plurality of openings through which wind passes so that the sight adjustment mechanism does not unduly shift the bow when in use, particularly in use outdoors.

An elevation carriage 20 is connected with the elevation bar for sliding movement along the bar. As will be developed below, a windage carriage 21 is connected with the elevation carriage and an archery sight is connected with the windage carriage. The elevation and windage carriages are adjustable by the user to adjust the position of the sight for optimum performance.

Figure 21:
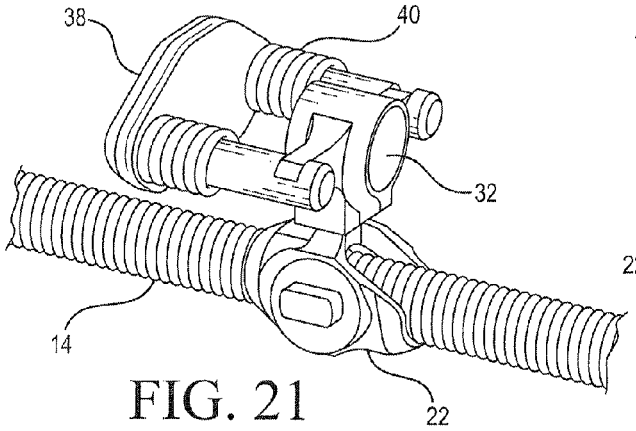
FIG. 21 is a detailed plan view of the button, link, and pivot nut of the drive mechanism for the elevation carriage.
Figure 22:
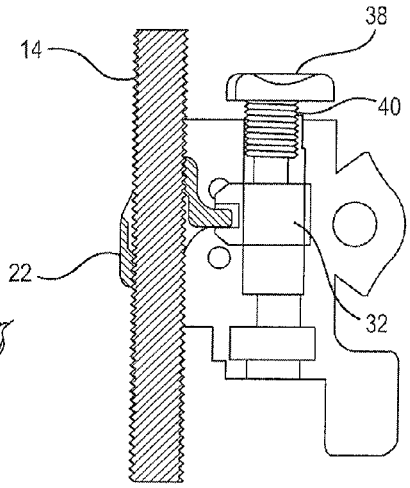
FIGS. 22 and 23 are plan views showing the pivot nut in the drive and release positions, respectively.

As shown in FIGS. 3-6, a drive mechanism releasably connects the elevation carriage 20 with the screw 14. The bottom of the elevation carriage contains an opening which receives a nut 22. The nut is pivotally connected with the carriage and is characterized by an axial throughbore 24 defined by an inner surface of the nut. The throughbore extends from a first or top end of the nut to a second or bottom end of the nut. Adjacent the first end, one side of the inner surface contains first threads 26. At the second end, the opposite side of the inner surface contains second threads 28. The first and second threads are shown in greater detail in FIGS. 22 and 23. The nut is threadably connected with the screw 14 as shown in FIG. 21 in which the elevation carriage has been removed for clarity. Rotation of the screw 14 by either of the knobs 16, 18 displaces the nut along the length of the screw. When the nut is connected with the elevation carriage, rotation of the screw serves to displace the carriage along the elevation bar. Preferably, the movement is incremental owing to the manner in which one of the knobs 16 is connected with the elevation bar. As is known in the art, a bearing (not shown) is arranged in a recess in an end surface of the elevation bar, and the surface of the knob which faces the end surface of the elevation bar contains a plurality of spaced openings adjacent to the outer edge of the knob, opposite the opening in the bar end surface. The knob openings are adapted to receive the bearing as the knob is rotated, so that the bearing acts as an incremental stop for the knob as it is rotated.

Figure 23:
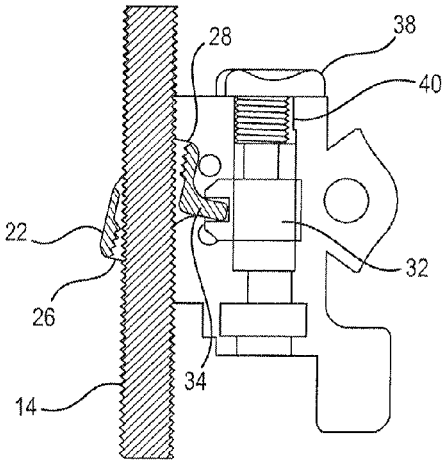

A characterizing feature of the drive mechanism for the elevation adjustment mechanism according to the invention is that the nut 22 is pivotally connected with the elevation carriage 12 via projections 30 on opposite sides of the nut which are seated in recesses in the carriage. A link 32 is connected between the carriage and the nut as shown in FIGS. 5 and 21-23. The link includes a slot 34 which receives a projection 36 on the nut 22. The link is operated by a thumb button 38 connected with the elevation carriage as shown in FIGS. 4-6 and 21-23. The thumb button is connected with the carriage via springs 40 which bias the button to a normal position. In the normal position shown in FIGS. 21 and 22, the posts 38*a* of the thumb button do not engage the link. However, when the button is depressed against the force of the springs, the posts 38*a* engage tabs 32*a* on the link to displace the link and thus tilt or pivot the nut 22 relative to the elevation carriage as shown in FIG. 23. When pivoted to the release position shown in FIG. 23, the first 26 and second 28 threads on the nut are free of the threads on the screw 14 so that the nut and carriage are free to slide along the screw. Thus, depression of the thumb button by the user enables the user to quickly change the elevation of the carriage relative to the elevation bar. This coarse adjustment is much quicker than manual rotation of the knobs 16, 18 to incrementally move the carriage relative to the elevation bar. When the thumb button is released, the link pivots the nut 22 to a drive position shown in FIGS. 21 and 22 wherein the first and second threads 26, 28 engage the threads of the screw 14.

Figure 8:
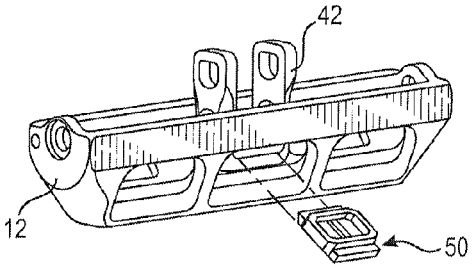
Figure 9:
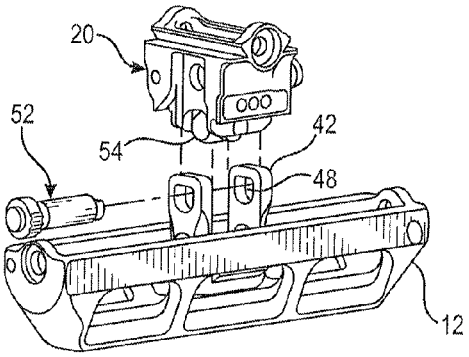
Figure 10:
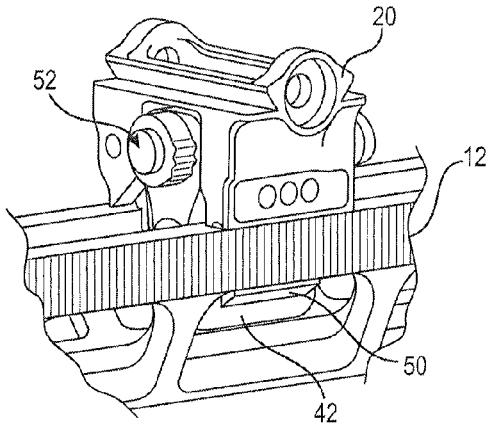
FIG. 10 is a perspective view of the assembled elevation carriage mounted on the elevation bar.
Figure 11:
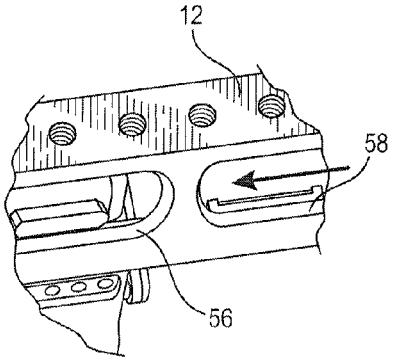
FIGS. 11-14 are perspective views, respectively, showing the arrangement of the tension and elevation gibs which are portions of the tension assembly used to adjust the tension between the elevation carriage and the elevation bar.

Referring now to FIGS. 7-10, mounting of the elevation carriage 20 on the elevation bar 12 will be described. The mounting system includes a yoke 42 which is arranged in a longitudinal slot 44 of the elevation bar. The yoke includes lower aligned openings 46 which receive the screw (not shown) of the elevation bar and upper aligned openings 48 which are used to connect the yoke with the elevation carriage as shown in FIG. 9. The yoke is arranged in the slot of the elevation bar 12 as shown in FIG. 8. A gib plate 50 is slid into the bottom of the yoke for reasons as will be described below. The elevation carriage is arranged between the upwardly extending legs of the yoke as shown in FIGS. 9 and 10 and a cam shaft 52 passes through the upper openings 48 of the yoke and through a bore 54 in the bottom of the elevation carriage.

Figure 12:
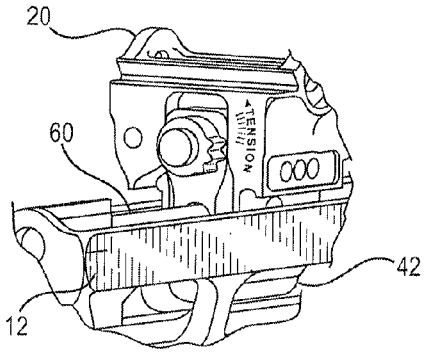
Figure 13:
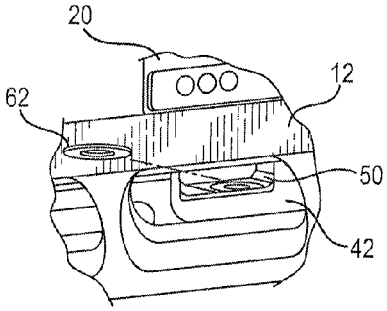
Figure 14:
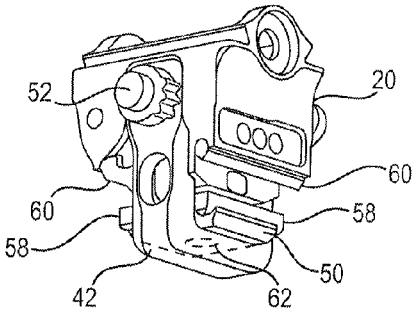

According to another feature of the invention, the tension of the elevation carriage relative to the elevation bar can be adjusted via a tension adjustment system which will be described with reference to FIGS. 11-20. The elevation bar shown in FIG. 11 includes gib shelves 56 on opposite slides of the slot 44. Tension gibs 58 are arranged on the gib shelves 56 and are held in place by the gib plate 50. In addition to the tension gibs 58, elevation gibs 60 are arranged in channels in the elevation bar as shown in FIG. 12. The elevation gibs are arranged between the lower surface of the elevation carriage and the elevation bar. A disc spring 62 is arranged between the yoke and the gib plate as shown in FIG. 13. The complete assembly is shown in FIG. 14 in which the elevation bar has been removed for clarity.

Figure 18:
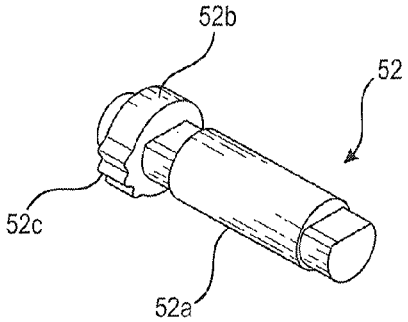
FIGS. 18-20 are perspective, end and side views of the cam shaft of the tension adjustment assembly.
Figure 19:
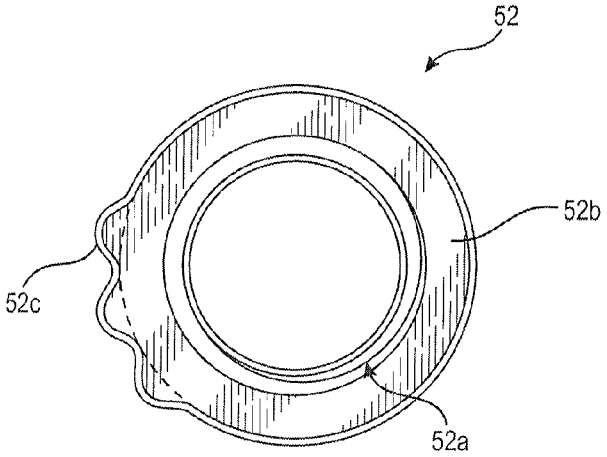
Figure 20:
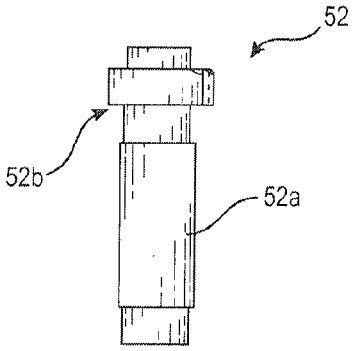

As shown in FIGS. 18-20, the cam shaft 52 has a generally cylindrical cam surface 52*a*. When the cam shaft is rotated, the cam surface abuts against the yoke to displace the yoke toward and away from the elevation carriage depending on the position of the cam surface. When the yoke is toward the elevation carriage, the carriage presses against the tension gibs to increase the tension between the carriage and the elevation bar. When the yoke is moved away from the elevation carriage by rotation of the cam shaft, the tension between the carriage and the elevation bar is released.

Figure 15:
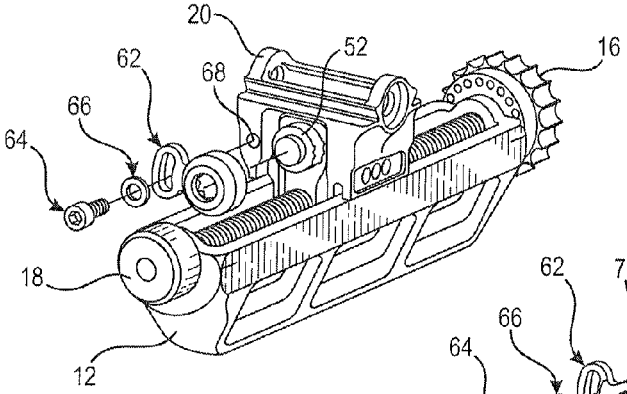
FIG. 15 is an exploded perspective view of a locking arrangement for the tension assembly of FIGS. 11-15.
Figure 24:
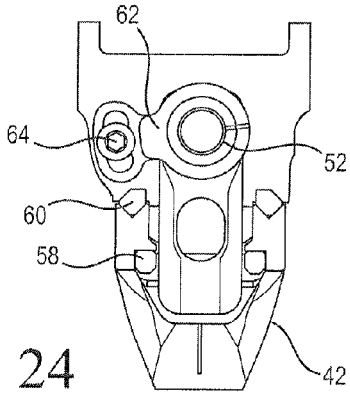
FIG. 24 is an end view of the tension assembly of FIG. 15 in the locked position.
Figure 25:
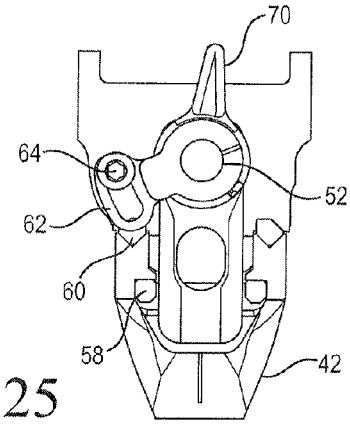
FIGS. 25 and 26 are end views of the tension assembly of FIG. 17 showing a locking lever in positions of lesser and greater tension, respectively.
Figure 26:
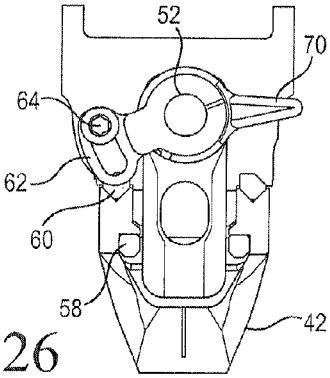

A locking mechanism for the cam shaft is shown in FIG. 15. The cam shaft 52 includes an external head portion 52*b* which includes a plurality of ribs 52*c* around its external surface. These are shown in detail in FIGS. 18-20. A tension stop 62 fits over the cam shaft head portion 52*b* and includes recesses which mate with the ribs 52*c* on the head. Referring once again to FIG. 15, a screw 64 and washer 66 are connected with a threaded opening 68 in the elevation carriage 20. The screw passes through a slot in the tension stop. With the screw loosened, the tension stop can be rotated to rotate the cam shaft to the desired tension. The screw is tightened to lock the tension stop in place and the tension is thus fixed. As shown in FIG. 24, with the tension stop fixed, the compression applied by the yoke to the tension gibs is also fixed.

Figure 16:
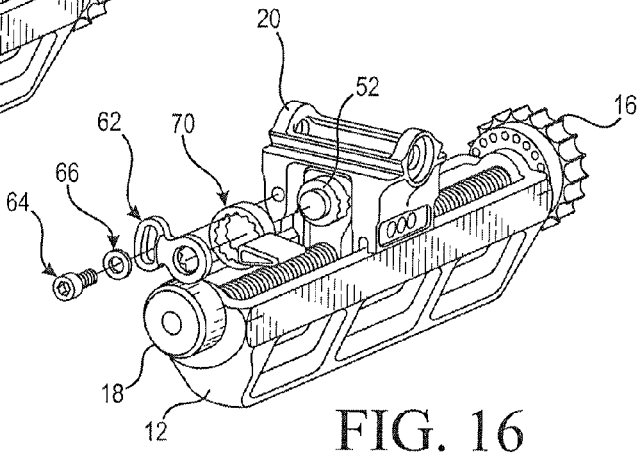
FIGS. 16 and 17 are exploded and assembled perspective views, respectively, of an adjustable locking arrangement according to an alternate embodiment of the tension adjustment assembly of FIGS. 11-14.
Figure 17:
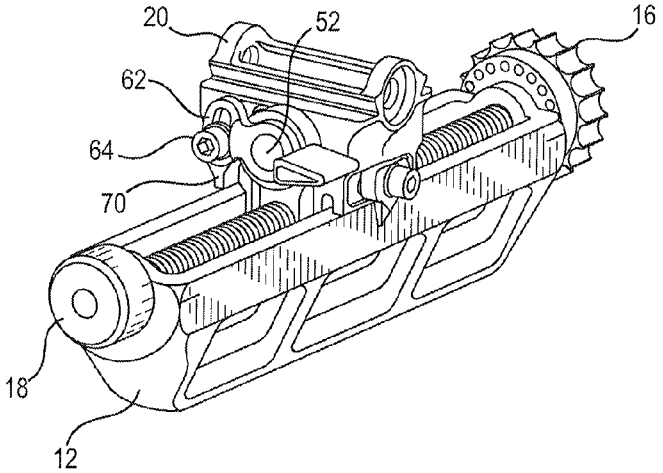

An alternate embodiment of the tension locking system is shown in FIG. 16. In this embodiment, a locking lever 70 is provided between the cam shaft 52 and the tension stop 62. The locking lever includes an opening having a ribbed inner surface which fits over the head 52*b* of the cam to engage the ribs 52*c* thereon. The lever is manually adjusted to rotate the cam shaft to a desired tension position as shown in FIGS. 24 (less tension) and 26 (greater tension). The locking lever is secured in place by operation of the screw 64 as in the embodiment of FIG. 15. The completely assembled tension adjustment system is shown in FIG. 17.

As set forth above and as shown in FIG. 2, a windage carriage 21 is connected with the elevation carriage 20. The windage carriage is adjustable with respect to the elevation carriage in a direction normal to the elevation adjustment of the carriage relative to the elevation bar 12.

Figure 27:
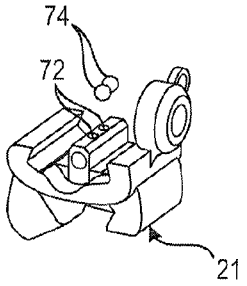
FIG. 27 is a perspective view of the windage carriage according to the invention.
Figure 28:
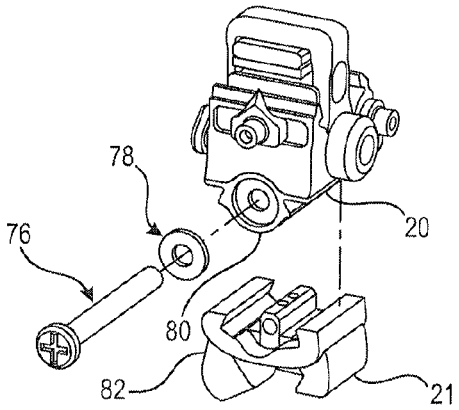
FIG. 28 is an exploded perspective view showing the connection between the windage carriage and the elevation carriage.
Figure 29:
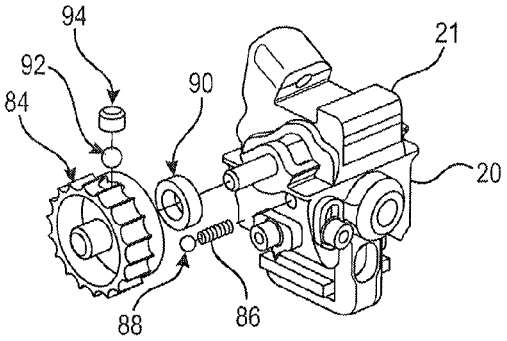
FIG. 29 is an exploded perspective view of the tension system for the windage carriage.

Referring to FIGS. 27-30, the connection between the windage carriage and the elevation carriage will now be described. In FIG. 27, the windage carriage 21 is shown upside down to illustrate two recesses 72 in the central bottom region of the carriage. The recesses receive two synthetic plastic ball bearings 74. The bearings are preferably formed of a DELRIN material. Referring now to FIG. 28, the windage 21 and elevation 20 carriages are configured to mate via dovetails on the elevation carriage. A screw 76 passes through a washer 78 and through aligned openings 80 and 82 in the windage carriage and elevation carriage, respectively. The opening 80 in the windage carriage is threaded whereas the openings in the elevation carriage are not. Thus, rotation of the screw displaces the windage carriage along the screw relative to the elevation carriage.

In order for the user to manually rotate the screw 76, a knob 84 is connected with the free end of the screw opposite the head end thereof. A spring 86 and steel ball 88 are arranged between the knob 84 and the windage carriage. A washer 90 is arranged on the free end of the screw to which the knob is attached. A synthetic plastic ball 92 is arranged in a tapped hole in a side surface of the knob and held in place by a set screw 94. Rotation of the knob 84 incrementally displaces the windage carriage along the screw relative to the elevation carriage. This displacement is similar to the displacement of the elevation carriage relative to the elevation bar upon rotation of the knob 16 connected with the elevation screw 14 as described above.

Figure 30:
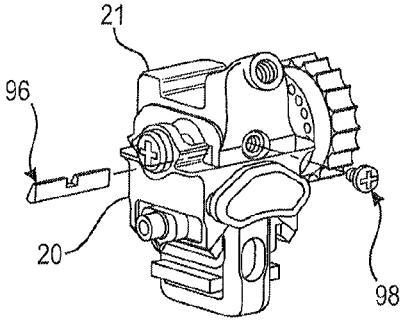
FIG. 30 is an exploded view of the tension system for the windage carriage.

A unique feature of the connection of the windage carriage and the elevation carriage is the use of a contoured or wavy windage gib 96 between the windage carriage and the dovetail portion of the elevation carriage as shown in FIG. 30. The upper surface of the windage gib contains a recess 96*a* intermediate the ends of the gib. When the windage gib is slid into the gap between the dovetail portion of the elevation carriage and the windage carriage, the gib is held in place by a retainer screw 98 which passes into a threaded opening in the windage carriage. The windage gib is formed of a resilient material such as DELRIN AF material which is a synthetic plastic material. The spring activation of the windage gib allows for the DELRIN AF material tensile strength displacement to provide the necessary tension between the windage carriage and the elevation carriage. This eliminates the need for an adjustment screw to vary the tension.

Figure 31:
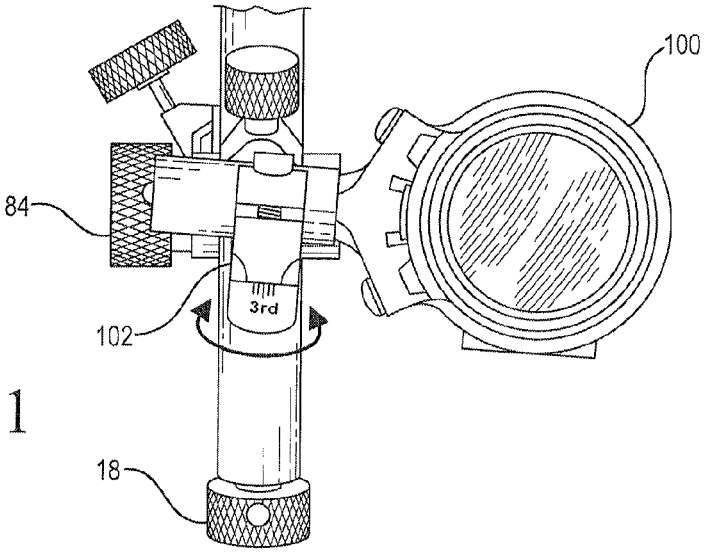
FIG. 31 is an end elevation view of the windage carriage having an archery sight connected therewith.

FIG. 31 shows a sight 100 connected with the windage carriage via a sight mount 102. The sight is adjustable in three dimensions: vertically by adjusting the elevation carriage relative to the elevation bar; laterally by adjusting the windage carriage relative to the elevation carriage; and rotationally by adjusting the sight mount 102 relative to the windage carriage.

While the preferred forms and embodiments of the invention have been illustrated and described, it will be apparent to those of ordinary skill in the art that various changes and modifications may be made without deviating from the inventive concepts set forth above.

What is claimed is:

1. Apparatus for adjusting the elevation of a sight on a bow, comprising (a) an elevation bar connected with the bow;

(b) an elongated screw rotatably connected with said elevation bar;

(c) a carriage for the sight mounted on said elevation bar; and (d) a drive mechanism including a pivot nut pivotally connected with said carriage and operable between a drive position wherein said pivot nut is connected with said screw and a release position wherein said pivot nut is disconnected from said screw, whereby when said pivot nut is connected with said screw, rotation of said screw incrementally displaces said carriage relative to said elevation bar, and when said pivot nut is released from said screw, said carriage may be manually displaced along said elevation bar.

2. Apparatus as defined in claim 1, wherein said pivot nut contains a throughbore extending between first and second ends thereof, an inner surface of said throughbore containing first threads on one side at one end of said pivot nut and second threads on an opposite side at the second end of said pivot nut, said first and second threads engaging threads on said screw when said pivot nut is in the drive position and said first and second threads being free of threads on said screw when said pivot nut is in the release position.

3. Apparatus as defined in claim 2, and further comprising a button connected with said carriage operable to pivot said pivot nut between the drive and release positions.

4. Apparatus as defined in claim 3, and further comprising a spring mechanism connected with said button for biasing said button to the drive position.

5. Apparatus as defined in claim 4, and further comprising a link connected with said button, said link containing a recess for receiving a tab on said pivot nut, whereby when said button is depressed relative to said carriage against said spring mechanism, said link is displaced to pivot said pivot nut to the release position, and when said button is released, said spring mechanism returns the button to a normal position and said link pivots said pivot nut to the drive position.

6. Apparatus as defined in claim 1, and further comprising a first tension system for adjusting the tension of said carriage relative to said elevation bar, whereby a user may adjust the freedom of movement of said carriage.

7. Apparatus as defined in claim 6, wherein said carriage comprises an elevation carriage, and further comprising a windage carriage adjustably connected with said elevation carriage for displacement in a direction normal to a direction of displacement of said elevation carriage relative to said elevation bar.

8. Apparatus as defined in claim 7, and further comprising a second tension system for providing tension between said windage carriage and said elevation carriage.

9. Apparatus for adjusting the elevation of a sight on a bow, comprising (a) an elevation bar connected with the bow;

(b) an elongated screw rotatably connected with said elevation bar;

(c) a carriage mounted on said elevation bar and connected with said screw for longitudinal displacement relative to said bar upon rotation of said screw; and (d) a tension system for adjusting the tension of said carriage relative to said elevation bar, whereby a user may adjust the freedom of movement of said carriage.

10. Apparatus as defined in claim 9, wherein said tension system further includes a tension screw connected with said carriage for biasing said carriage relative to said elevation bar and a yoke adjustably connected with said carriage, said yoke and said carriage being arranged on opposite sides of said elevation bar, whereby said yoke is drawn toward said carriage upon rotation of said tension screw in a first direction to increase tension between said carriage and said extension bar and said yoke is moved away from said carriage upon rotation of said tension screw in a second direction to decrease tension between said carriage and said extension bar.

11. Apparatus as defined in claim 10, wherein said tension screw includes a cam surface between said carriage and said yoke and further wherein rotation of said cam surface by said tension screw displaces said yoke toward and away from said carriage.

12. Apparatus as defined in claim 11, wherein said tension system further includes at least one tension gib arranged between said yoke and said extension bar.

13. Apparatus as defined in claim 12, wherein said tension system further includes at least one elevation gib arranged between said carriage and said extension bar.

14. Apparatus as defined in claim 13, wherein said tension system further comprises a spring washer connected with said yoke to provide constant tension between said carriage and said elevation bar.

15. Apparatus as defined in claim 14, wherein said tension system further includes a locking lever connected with a head of said cam shaft externally of said carriage, said locking lever being manually operated to rotate said cam shaft to adjust the tension applied by said cam to said yoke and to said tension and elevation gibs against said tension rail.

16. Apparatus as defined in claim 15, and further comprising a tension stop connected with said head of said cam shaft externally of said carriage, said tension stop being adjustable with respect to said carriage to fix said cam shaft in a selected position.

17. Apparatus for adjusting a sight on a bow, comprising (a) an elevation bar connected with the bow;

(b) an elevation carriage mounted on said elevation bar for displacement relative thereto in a first direction;

(c) a windage carriage adjustably connected with said elevation carriage for displacement in a second direction perpendicular to said first direction; and (d) a contoured spring gib arranged between said windage carriage and said elevation carriage for providing tension therebetween.

18. Apparatus as defined in claim 17, wherein said spring gib contains a slot in an edge intermediate the ends of said gib.

19. Apparatus as defined in claim 18, wherein said contoured spring gib is formed of a synthetic plastic material having a tensile strength displacement.

20. Apparatus as defined in claim 19, and further comprising a screw threadably connected with said windage carriage, said screw passing through said notch in said contoured spring gib to retain said contoured spring gib in position.

* * * * *